US005119053A

United States Patent [19]

Mostosi

[11] Patent Number: 5,119,053

[45] Date of Patent: Jun. 2, 1992

[54] SELF-COORDINATED DEVICE FOR THE CONTROL AND PROTECTION OF ELECTRICAL EQUIPMENT

[75] Inventor: Angelo Mostosi, Bergamo, Italy

[73] Assignee: ABB Sace S.p.A., Bergamo, Italy

[21] Appl. No.: 666,652

[22] Filed: Mar. 8, 1991

Related U.S. Application Data

[63] Continuation of PCT/EP90/00826, May 22, 1990.

[30] Foreign Application Priority Data

Aug. 9, 1989 [IT] Italy ..... 21485 A/89

[51] Int. Cl.[5] ..... H01N 75/00

[52] U.S. Cl. ..... 335/6; 335/172; 335/185

[58] Field of Search ..... 335/6, 8-10, 335/35, 131-132, 202, 167-175, 185-190

[56] References Cited

U.S. PATENT DOCUMENTS

| | | | |
|---|---|---|---|
| 4,495,538 | 1/1985 | Thomas | 335/6 |
| 4,973,929 | 11/1990 | Duchenin | 335/132 |
| 5,012,214 | 4/1991 | Faffart | 335/6 |
| 5,055,811 | 10/1991 | Kakizoe et al. | 335/59 |

*Primary Examiner*—Gerald P. Tolin
*Assistant Examiner*—Lincoln Donovan
*Attorney, Agent, or Firm*—Burns, Doane, Swecker & Mathis

[57] ABSTRACT

Self-coordinated device for the control and protection of electric motors and electrical equipment, for example, comprising, in a housing (2), a single control solenoid (5), a magnetothermal release device (M), a movable main contact (4) with a double break for each phase, which main contacts (4) are mounted on a contact-carrying bar (25) which is slidable and elastically preloaded (31), with which there interacts a composite mechanism (A) for the control of circuit-opening comprising two interacting mechanisms (B; C). One mechanism (B) interacts with the control solenoid (5) for desired circuit openings and for current surges. Both mechanisms (B; C) cause circuit-opening when short-circuit currents occur, more precisely with a double pushing action on the contact-carrying bar (25). The mechanism (C) also interacts with a locking mechanism (D) interacting in turn with a control knob (3) for the manual opening of the main contacts (4).

4 Claims, 7 Drawing Sheets

1
2
3
4
5
6
7
8
9
10
11
12
14
15
16
17
18
19
21
22
23
24
25
26
27
28
29
30
31
33
34
38
42
S1
S2
S
M
B
C
D
+
-

SELF-COORDINATED DEVICE FOR THE CONTROL AND PROTECTION OF ELECTRICAL EQUIPMENT

This is a continuation of international application PCT/EP 90/00826 filed on May 22, 1990, designating the United States. The international application is entitled to the foreign priority filing date of Italian patent application 21485A/89 filed on Aug. 9, 1989.

DESCRIPTION OF THE INVENTION

The subject of the present invention is a self-coordinated device for the control and protection of electrical equipment.

Although the coordinated device according to the invention is provided in general for the control and protection of many different kinds of electrical equipment, this text will refer for simplicity's sake to electric motors.

For the control of electric motors and their protection against overloading and short-circuiting use is usually made at present of a combination of various appliances and electrical components that consists of a circuit-breaker, with an associated relay or magnetic release device, for protection against short-circuit currents, and of a contactor with a thermal relay, which contactor serves for the operations of starting and stopping the motor and the thermal relay serves for the opening of the contacts of the contactor when current surges occur.

These physically independent electrical components may be produced by various companies and may individually perform various tasks. For the control and protection of motors these must therefore be coordinated beforehand to each other with respect to their ratings and according to the power of the particular motor considered. A further disadvantage of using this plurality of electrical components lies in the considerable bulk which is due to putting together these individual devices. This drawback is then reflected particularly unfavourably when it is necessary to control a large number of motors, as is the case for example in a refinery, in which many thousands of motors are provided and the associated electrical control and protection equipment is arranged in individual panels in the control cabinets. A further drawback to the known solution is to be found in the considerable expenditure of time and labour necessary for making the great number of electrical connections to connect the various electrical components together. These electrical connections may in turn be the cause of defective contacts and may thus be prejudicial to the working of the particular circuits.

The aim of the present invention is to provide a self-coordinated device for the control and protection of electrical equipment which can obviate the disadvantages and drawbacks indicated above in the prior art, which device requires a drastically limited number of electrical components and has a composite mechanism for the opening of the main contacts of the circuit breaker which acts when necessary and with reinforced action when in the presence of short-circuit currents, the device being accommodated in a single housing of limited bulk.

Also within the scope of the aim indicated above is the provision of a device which after short-circuit currents have caused circuit-opening requires a preliminary manual intervention before closing the main contacts again, in which device the said opening for short-circuit currents is signalled visually.

The aim of the present invention is achieved with a device for the control and protection of electrical equipment, which is characterized in that it comprises, in a single housing, a) a control solenoid with a movable armature which can be supplied with power from its own remotely controlled supply circuit, known per se, b) a magnetothermal release device having a magnetic release device and a thermal release device, c) for each phase, a movable main contact with a double break and respective arc chambers, known per se, which main contacts are mounted on a contact-carrying bar supported slidingly in the housing, elastically preloaded in the direction for closing the main contacts and displaceable in the direction for opening the said main contacts by means of a composite mechanism which controls the opening of the main contacts comprising a first control mechanism, responding to a deenergizing of the control solenoid caused manually by means of a control knob or by the thermal release device when current surges occur, and a second control mechanism responding to short-circuit currents, which second control mechanism, when short- circuit currents occur, interacts firstly with the first control mechanism and then acts directly on the contact-carrying bar to give a reinforced opening of the main contacts, the said second mechanism interacting similarly with a mechanism which locks the manual control knob for opening the main contacts.

Further structural features of the self-coordinated device proposed may be seen in the subclaims and in the following description.

With the self-coordinated device proposed, various important advantages are achieved. In the first place it requires a single control solenoid whose movable armature acts at the same time, for short-circuit currents, as a mechanical locking constraint which can be released by the intervention of the operator. The composite opening mechanism proposed enables the main contacts to be opened by manual control, by remote control, by current surges and by short-circuit currents, in the last case advantageously with a double pushing action on the contact-carrying bar whereby the circuit is broken quickly and safely. The same composite opening mechanism advantageously acts on a mechanism which locks the control knob. The magnetic and thermal release devices are advantageously grouped together. This contributes to a particularly compact embodiment of the proposed self-coordinated device, which can be accommodated in a single case of small dimensions. While having the same electrical characteristics, this embodiment has an order of magnitude of bulk which is some 30% of the bulk required by currently known solutions. This also works 'out favourably in a corresponding marked drop in production costs. A further advantage of the proposed self-coordinated device is to be seen in the fact of providing components which serve several functions and a control knob for the manual opening of the main contacts which by its position signals that circuit-opening has occurred following the appearance of a short circuit and which for safety reasons must be manually controlled to enable the main contacts to be closed again.

Further characteristics, advantages and details of the self-coordinated control and protection device according to the invention will appear from the following description given with reference to the attached drawings, which show diagrammatically a preferred embodiment of the self-coordinated device according to the invention. In the drawings.

Figure 11:
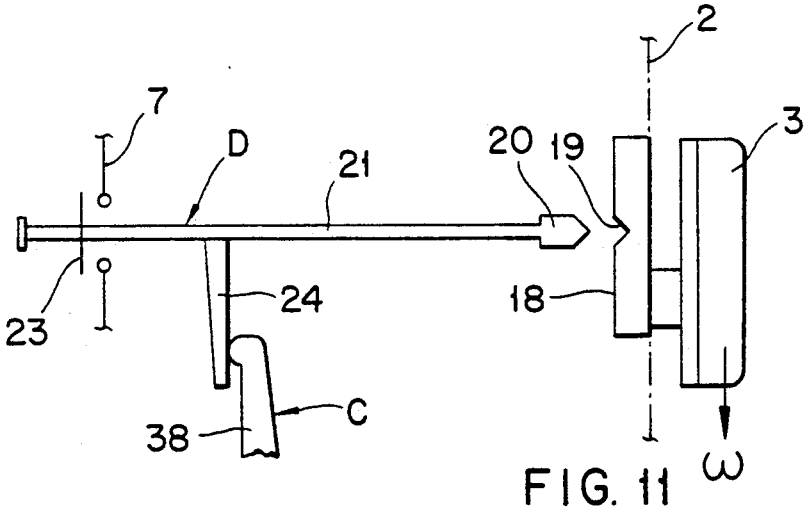
Figure 11A:
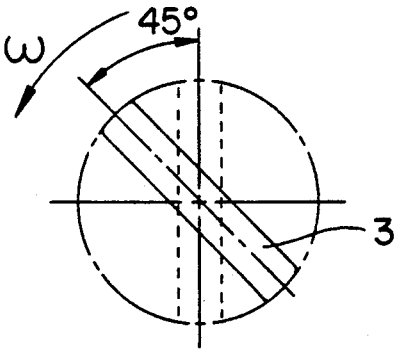

FIGS. 2–11 show details on an enlarged scale reproducing the various positions which can be assumed by the respective movable parts that are provided, in the various conditions of control and protection of the device according to the invention; and FIG. 11A shows a front view of the control knob, similar to FIG. 1B, the broken line again indicating the control knob in the position where the main contacts are open while the unbroken line indicates an intermediate position, signalling that the main contacts have been opened following a short circuit.

The self-coordinated device for the control and protection of electrical equipment, for example electric motors, is indicated as a whole by 1. It is accommodated in a housing made of an insulating material of high mechanical and dielectric strengths designated 2, projecting from which is a rotatable control knob 3 for opening and preparing the closing of the main contacts, as mentioned below. The control knob 3 is preloaded with a spring, in a manner not otherwise illustrated. For each phase, for example S with associated entry and exit terminals S1 and S2, there is provided a main contact 4 with a double break, and two known arc chambers, for example of the type with metal plates for breaking up the arc, not otherwise illustrated. The self-coordinated device 1 also comprises a solenoid 5 for the remote closing and opening of the main contacts 4, and a magnetothermal release device M mentioned in more detail below. The electrical circuit powering the solenoid 5 is indicated with 7, while 8 and 9 indicate the opening and closing push-buttons respectively for the remote control of the main contacts 4. 10 indicates a self-retaining contact and 11 indicates an auxiliary opening contact with associated contacts for a known auxiliary signalling circuit, not otherwise illustrated. 12 indicates the movable armature of the solenoid 5, while the movable armature of the coil 14 of the magnetothermal release device M is indicated with 6. The magnetothermal release device M also comprises a bimetal element 15 anchored at the end 16, and which at its other end has a flag or similar 17, for pushing.

On the back 18 of the control knob 3 is a cam groove 19 with a cross-section, in the example illustrated, of 90°, in which there is engaged the end 20 of the control rod 21, slidingly supported in the housing 2, preloaded at the other end by a spring 22 and supporting a circuit-opening contact 23, inserted in series in the supply circuit 7 and presenting a lug 24 projecting downwards, the said parts forming a mechanism for locking the control knob 3 and indicated as a whole by D. The composite mechanism A will now be described, formed by the mechanisms B and C, the first of which B is provided for opening the main contacts 4 as manually controlled on the device 1 itself or remotely, or indeed following the appearance of current surges (currents that is of around 6 to 15 times the respective nominal current envisaged), while both the mechanisms B and C interact with each other to open the main contacts 4 on the appearance of short-circuit currents, and with the locking mechanism D, as mentioned below.

Figure 1:
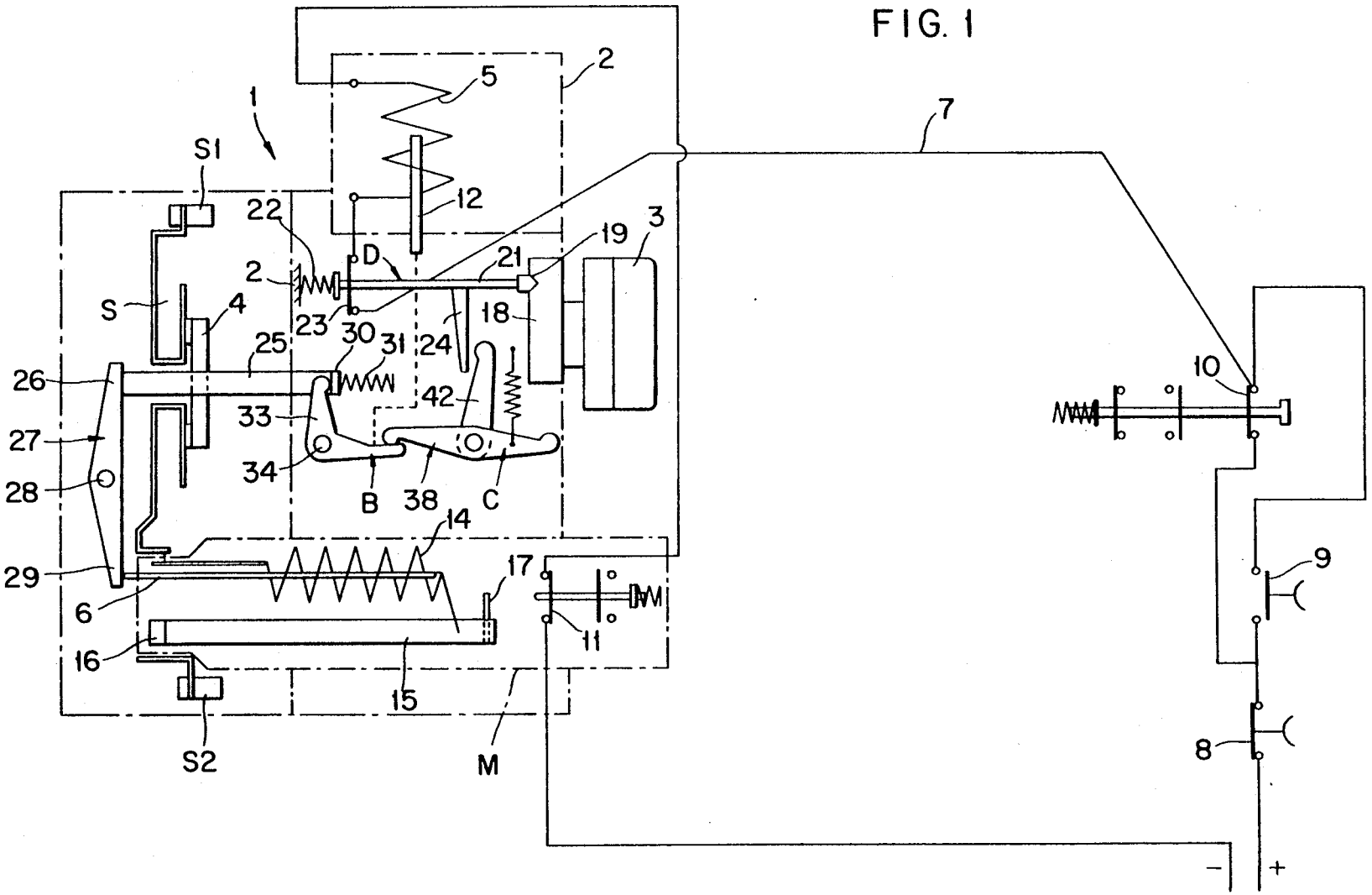
FIG. 1 shows a basic vertical cross-section through the middle of a self-coordinated control and protection device according to the invention for electrical equipment, in which cross-sectional view the electrical components that are provided are also shown as is, for the sake of completeness, the electrical supply circuit.
Figure 1B:
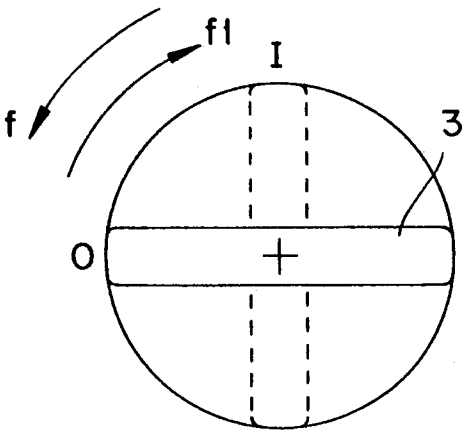
FIG. 1B shows a front view of the control knob for manually opening the main contacts, more specifically in the position with the main contacts closed, indicated by the broken line, and in the position with the main contacts open, indicated by the unbroken line.
Figure 1A:
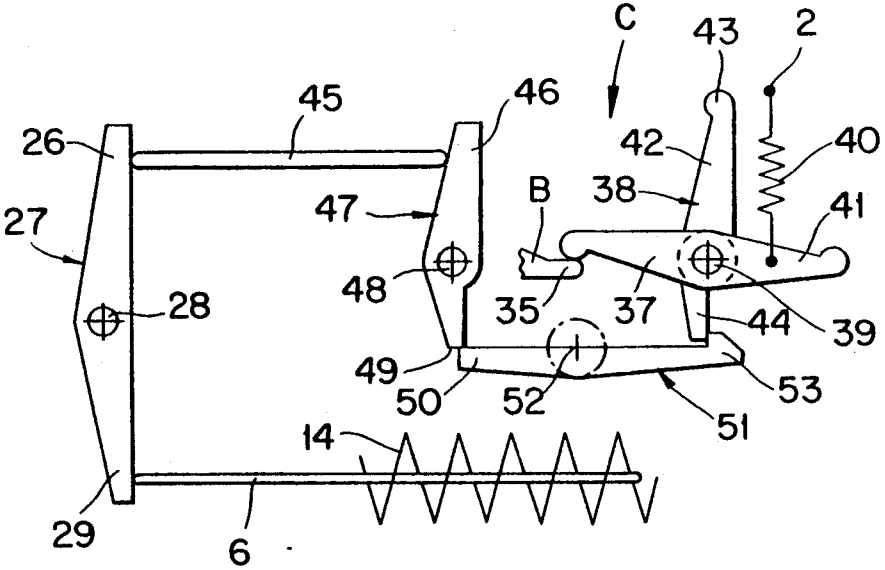
FIG. 1A shows a basic vertical cross-section through the composite mechanism for controlling the opening of the main contacts when short-circuit currents occur, illustrating parts of the said composite mechanism which are not shown in FIG. 1, which section is taken in a plane parallel to and at a distance from the midplane of the device.
Figure 2:
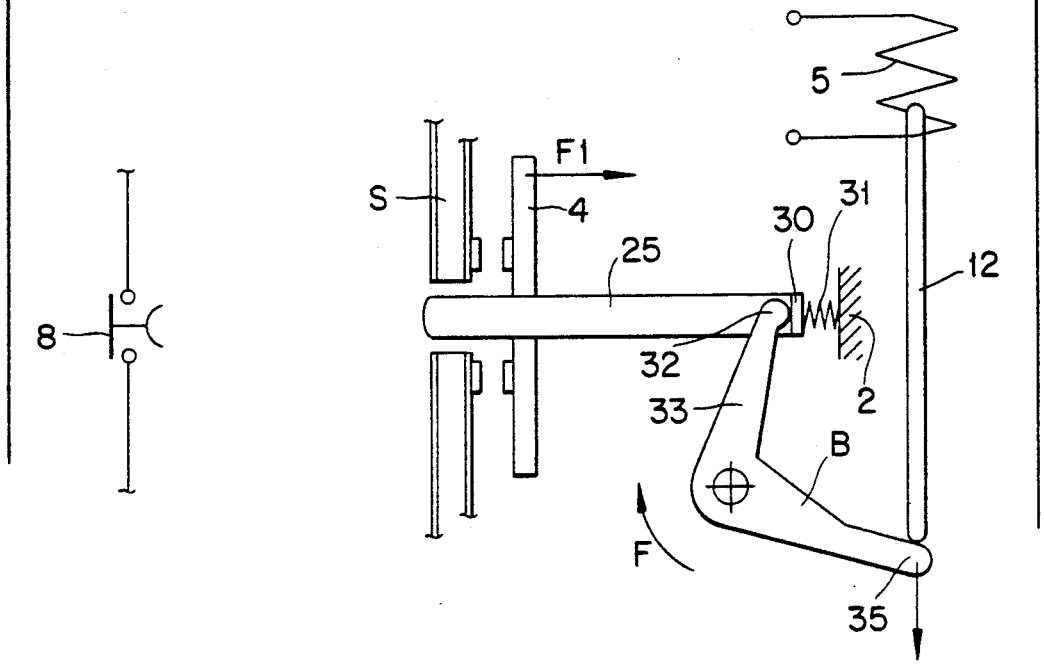
Figure 3:
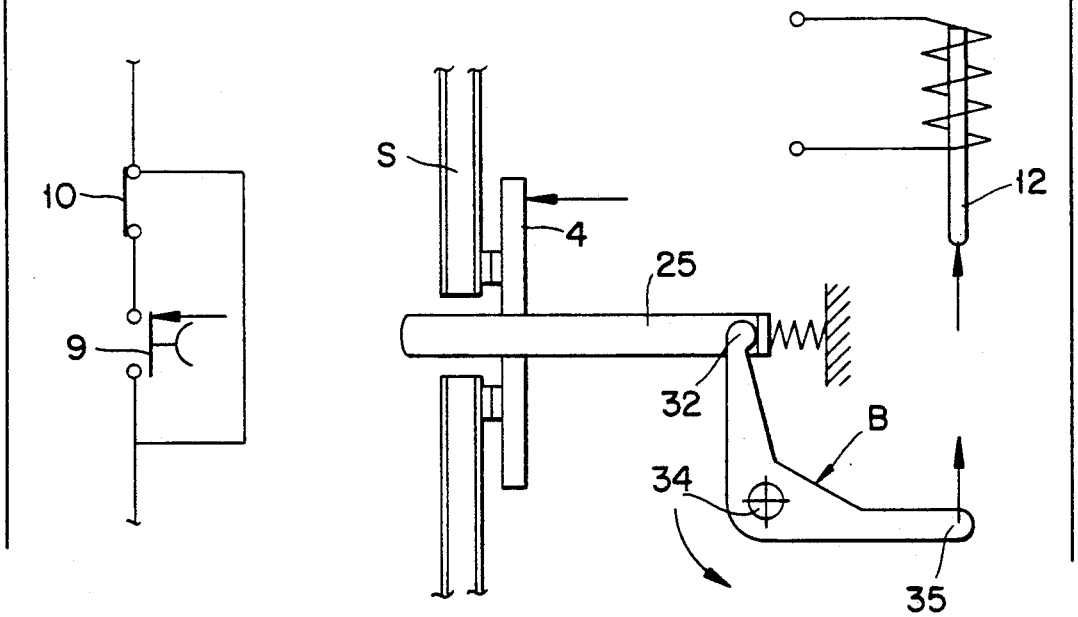

The main contacts 4 are mounted on a contact-carrying bar 25, supported in the housing 2 so as to be able to slide under the action of an elastic preloading and of the mechanisms C and B as mentioned below. When the contacts 4 are in the closed position the end near the contacts 4 of the contact-carrying bar 25 is practically in contact with an end 26 of a rocking lever 27, pivoted at 28 and in contact end-to-end at its lower part 29, with the armature 6 of the magnetic release device 14. The rear end of the contact-carrying bar 25 is preloaded by a spring 31 and has a projection or bend 30 against which bears the upper end 32 of an angle lever 33 which can oscillate, pivoting about 34 and whose other end 35 is in contact with a stop 36 for exerting a pushing action on the said lever 33, as mentioned below. The oscillating lever 33 forms the mechanism B of the composite mechanism A. The stop 36 belongs to the mechanism C which will now be described. In the embodiment illustrated the stop 36 constitutes the end of one arm 37 of an oscillating star 38 which is substantially in a cross shape and pivots about 39. As can be seen from the drawing, the star element 38 is preloaded by a spring 40, acting on the arm 41 opposite the arm 37. The end 43 of the upper arm 42 is opposite the lug 24 of the locking mechanism D which interacts with the control knob 3. The rocking lever 27 extends axially somewhat and is hence able to engage at the top not only with the contact-carrying bar 25 but also with a releasing rod 45 interposed between the said rocking lever 27 and an upper part or end 46 of the releasing rocker arm 47 pivoting about 48, with a stopping and positioning end 49 which when the main contacts 4 are closed is engaged with the end 50 of an intermediate rocker arm 51, which pivots about 52 and whose other end 53, which is made like a hook, more precisely with the outer end rounded off to facilitate reengagement in the hook, acts as a stop and detent for the arm 44 of the elastically preloaded star element 38. The above-described parts 26–29 and 36–53 form the mechanism C. The positions illustrated for the internal control mechanisms that have been described refer to their position when the main contacts 4 are closed, that is in normal operation, as illustrated in FIGS. 1 and 1A. The directions of movement, or oscillation of the various movable parts are indicated on the drawing by arrows.

The working of the coordinated device according to the invention under the various conditions is as follows: under normal operating conditions, FIGS. 1 and 1A, the movable armatures 12 and 6 are in the withdrawn position, the spring 31 holds the main contacts 4 closed and the control knob 3 is turned into the vertical position, FIG. 1B, that is to say the contact 23 of the supply circuit 7 is closed. The main contacts 4 may be opened manually by rotating the control knob 3 through 90° in the direction of the arrow f, and this, acting through the locking mechanism D, causes the contact 23 to open. The solenoid 5 is hence deenergized and the movable armature 12 falls onto the end 35 of the oscillating lever 33, FIG. 2, which rotates in the direction of the arrow F and moves the contact-carrying bar 25 in the direction of the arrow F1, consequently compressing the spring 31 and opening the main contacts 4. The armature 12 remains on the oscillating lever 33 and acts on it as a locking constraint. To reclose the main contacts 4 a double intervention is required, one which is manual, rotating the control knob 3 back through 90° in the direction of the arrow f1, and a remote one which is electrical, pushing the circuit-closing push-button 9, or else directly on the device by pushing a test button, not otherwise illustrated, incorporated in the housing 2 and allowing immediate verification of operation.

To open the main contacts 4 remotely the opening contact 8 is pushed. The solenoid 5 is deenergized, the movable armature 10 falls and the phases mentioned above in relation to the manual opening of contacts 4 by the control knob 3 take place.

The remote closing of the main contacts 4 takes place by pushing the push-button 9, on releasing which the continuity of the supply circuit 7 is ensured by the simultaneous closing of the retaining contact 10. In this way the solenoid 5 is energized, its armature 10 is drawn back into the internal position and the spring 31, being no longer countered, causes the closure of the main contacts 4 and the repositioning of the oscillating lever 33, FIG. 3, that is of the mechanism B, FIG. 3.

Figure 4:
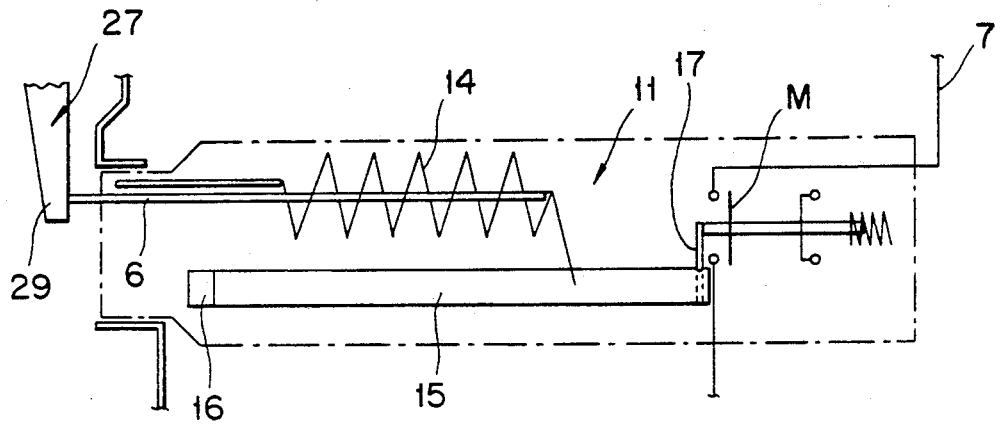
Figure 5:
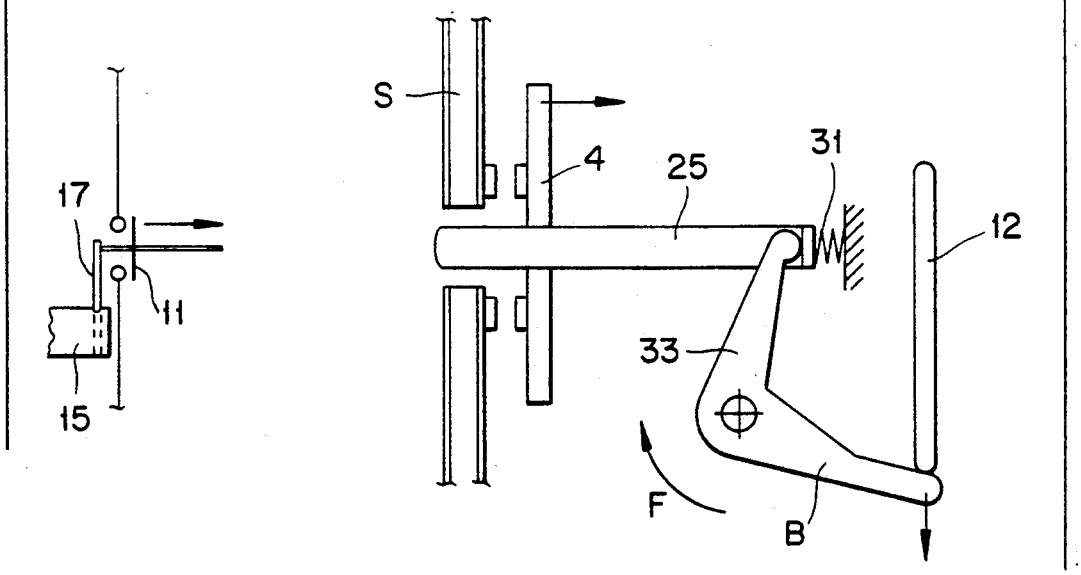

When overload currents occur, that is currents of some 6–15 times the nominal envisaged current, the bimetal element 15 becomes deformed and its pusher flag 17 causes the auxiliary contact 11 to open, FIG. 4, consequently deenergizing the solenoid 5. The movable armature 12 falls, FIG. 5, and there take place once again the phases described above in relation to the opening of the main contacts 4 by intervening on the control knob 3, or on the opening push-button 8. Closure of the main contacts takes place in the manner already mentioned above.

Figure 6:
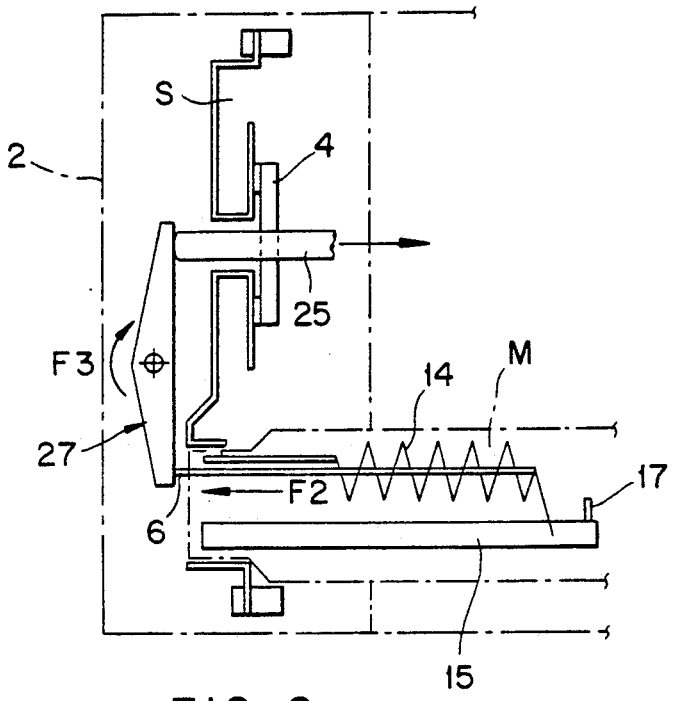
Figure 7:
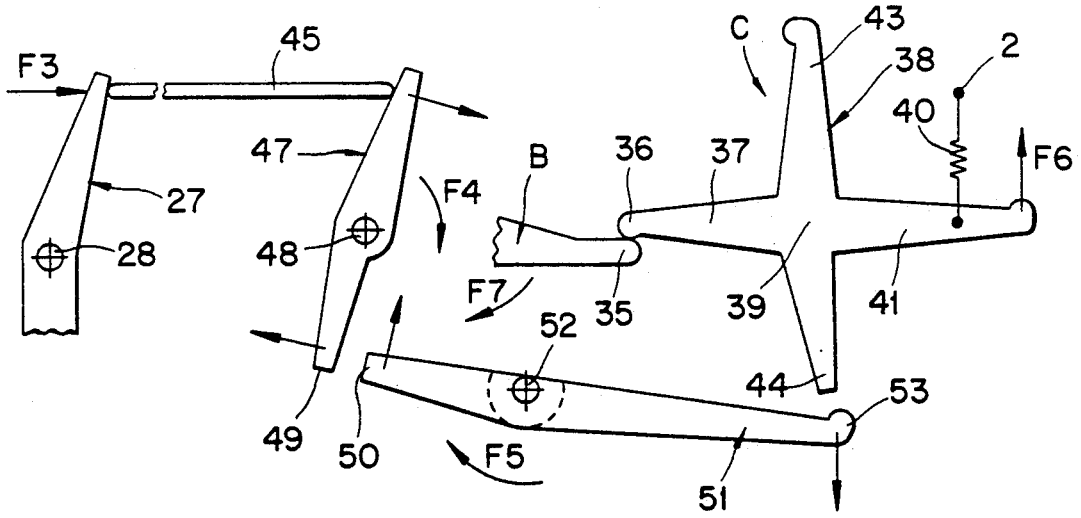
Figure 8:
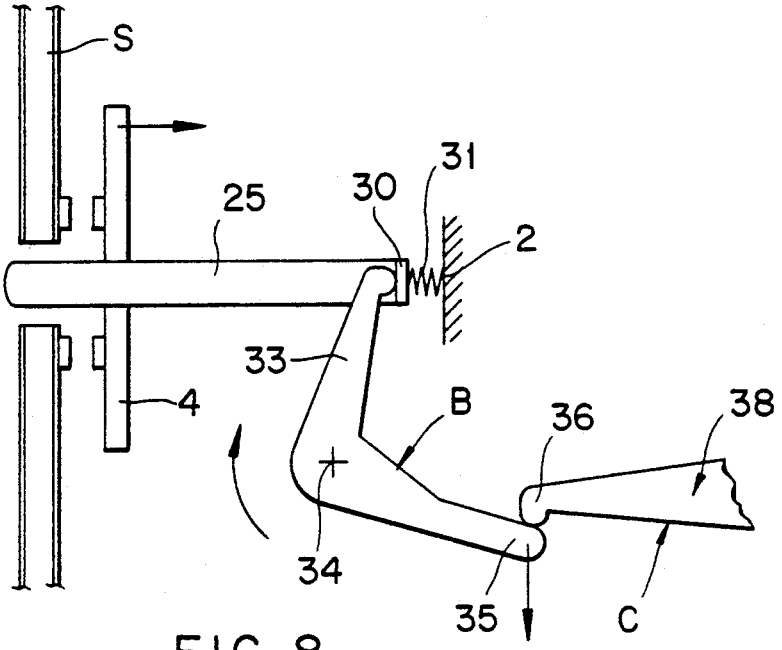
Figure 9:
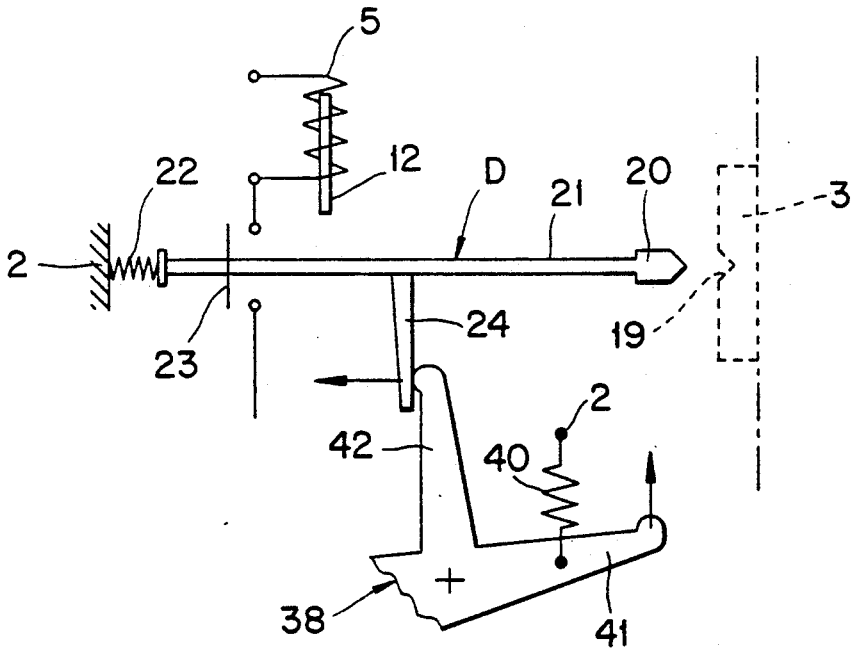
Figure 10:
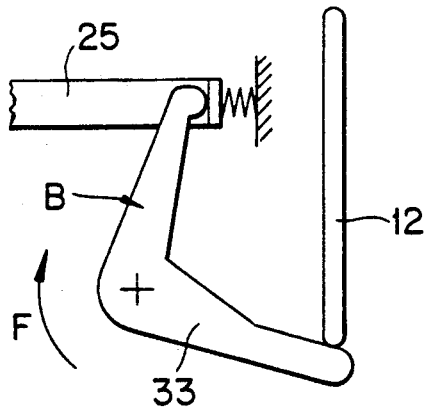

When a short-circuit current occurs, however, the movable armature 6 in the coil of the magnetic release device 14 comes out in the direction of the arrow F2 making the rocking lever 27 rotate in the direction of the arrow F3, FIG. 6. This rotation causes pushes to be given, at different moments in time, to the contact-carrying bar 25 and the intermediate releasing rod 45. The rocking lever 27 first acts on the intermediate releasing rod 45, which causes the releasing rocker arm 47 to oscillate in the direction of the arrow F4, FIG. 7. Thus the end 49 of the said releasing rocker arm 47 is disengaged from the end 50 of the intermediate rocker arm 52, which executes an oscillation in the direction of the arrow F5 and its hook end 53 disengages from the arm 44 of the star element 38 which is elastically preloaded and which therefore, following the action of the spring 40, executes an oscillation in the direction of the arrow F6 and the end 36 of its forward arm 35 causes the oscillating lever 33, that is the mechanism B, to oscillate in the direction of the arrow F7 in the direction of opening the main contacts 4, FIG. 8. As it rotates, the star element 38 also acts through its arm 42 on the lug 24 of the locking mechanism D interacting with the control knob 3, FIG. 9. The contact 23 accordingly opens, thereby deenergizing the solenoid 5 and causing its armature 12 to fall, FIG. 10. As mentioned above the movable armature 12 then acts as a mechanical locking "constraint" on the mechanism B until the operations of manually restoring the control knob 3 and pushing the push-button 9 have been carried out to energize the solenoid 5. As mentioned above, the rocking lever 27 acts also at a second moment in time directly on the contact-carrying bar 25, thereby contributing to opening the contacts 4 safely and immediately in addition to the opening force received by the contact-carrying bar 25 from the oscillation of the mechanism B in the opening direction in response to stressing from the star 38 of the mechanism C and the falling of the movable armature 12. With short-circuit currents, therefore, the opening of the main contacts 4 is determined by two pushing actions caused by the magnetic release device 14. The intervention of this last, which also disengages the locking mechanism D from the cam groove 19 of the control knob 3, FIG. 11, advantageously causes a 45° rotation of the latter, FIG. 11A, which thus visually signals that the contacts 4 have opened owing to a short circuit. To close the main contacts 4 again it will be necessary to intervene twice manually on the control knob 3, more specifically firstly by rotating it through a further 45° bringing it to the horizontal position, which is necessary to allow the locking mechanism D to engage again in the cam groove 19 of the control knob 3 and allow the star element 38 to return to its working position, and secondly by rotating the control knob 3 back through 90° to bring it into the vertical position. These two manual operations therefore allow the mechanisms B and C of the mechanism A to position themselves correctly for the subsequent operation by remote electrical control of closing the main contacts 4 by acting on the closing push-button 9. As already mentioned above the energizing of the solenoid 5 causes the movable armature 12 to be withdrawn, consequently removing the mechanical locking "constraint" on the mechanism B.

From the above description of the structure and working of the self-coordinated device for the control and protection of electric motors and electrical equipment, for example, according to the invention, it can be seen that the same effectively achieves both the aim of the invention and the advantages indicated above.

Naturally the invention equally embraces all such means as constitute technical equivalents of the means described, as well as their various combinations.

I claim:

1. Self-coordinated device for the control and protection of electrical equipment, characterized in that it comprises, in a single housing (2), a) a control solenoid (5) with a movable armature (12), which can be supplied with power from its own remotely controlled supply circuit (7), known per se, b) a magnetothermal release device (M) having a magnetic release device (14, 6) and a thermal release device (15), c) for each phase, a movable main contact (4) with a double break and respective arc chambers, known per se, which main contacts (4) are mounted on a contact-carrying bar (25) supported slidingly in the housing (2), elastically preloaded (31) in the direction for closing the main contacts (4) and displaceable in the direction for opening the said main contacts (4) by means of a composite mechanism (A) which controls the opening of the main contacts (4) comprising a first control mechanism (B), responding to a deenergizing of the control solenoid (5) caused manually by means of a control knob or by the thermal release device (15) when current surges occur, and a second control mechanism (C), responding to shortcircuit currents, which second control mechanism (C), when short-circuit currents occur, interacts firstly with the first control mechanism (B) and then acts directly on the contact-carrying bar (25) to give a reinforced opening of the main contacts (4), the said second mechanism (C) interacting similarly with a mechanism (D) which locks the manual control knob (3) for opening the main contacts (4).

2. Self-coordinated device, according to claim 1, characterized in that the first control mechanism (B) responding to a deenergizing of the control solenoid (5) consists of an oscillating lever (33) pivoted (34) on the housing (2) so as to oscillate freely, one end (32) of which oscillating lever (33) is in contact with a stop (30) of the contact-carrying bar (25) while the other end (35) of the said oscillating lever (33) is supported by an oscillating stopping arm (37) of the second control mechanism (C) responding to short-circuit currents and this end (35) is arranged and shaped in such a way as to be struck by the movable armature (12) released by the control solenoid (5).

3. Self-coordinated device according to claim 1, characterized in that the second control mechanism (C) responding to short-circuit currents comprises a first rocking lever (27) pivoted (28) on the housing (2) so as to oscillate freely, with one end (29) of which rocking lever (27) the movable armature (6) of the magnetic release device (14) engages, while with the other end (26) of the said rocking lever (27) there engages one of the ends of an intermediate releasing rod (45), which at its other end engages with one end (46) of a releasing rocker arm (47), pivoted (48) on the housing (2) so as to oscillate freely, and positioned at its other end (49) on an intermediate rocker arm (51) which pivots (52) on the housing (2) so as to oscillate freely and has a stopping end (53) acting as a detent for one arm (44) of an oscillating star (38) which is pivoted (39) on the housing (2) so as to oscillate freely and is additionally provided with an arm (37) which acts as a bearing stop for the oscillating lever (33) of the first control mechanism (B) responding to deenergizing of the control solenoid (5), and also with an arm (41) which supports a spring (40) for the elastic preloading and a further arm (42) for pushing the control knob (3) locking mechanism (D) away from the control knob.

4. Self-coordinated device according to claim 1, characterized in that the mechanism (D) for locking the control knob (3) consists of a rod (21) which is supported slidingly in the housing (2), is elastically preloaded (22), supports an electric contact (23) for opening the electrical supply circuit (7) and engages with one end (20) under normal operating conditions in a cam groove (19) which is let into the control knob (3) for manually opening the main contacts (4), while from the said intermediate releasing rod (21) extends the lug (24) interacting with the arm (42) of the star (38) which can oscillate in response to the intervention of the magnetic release device (14, 6) to cause the disengagement of the releasing rod (21) from the control knob (3).

* * * * *